US009303521B2

(12) United States Patent
Arnold

(10) Patent No.: US 9,303,521 B2
(45) Date of Patent: Apr. 5, 2016

(54) INTERSTAGE COVERPLATE ASSEMBLY FOR ARRANGING BETWEEN ADJACENT ROTOR STAGES OF A ROTOR ASSEMBLY

(71) Applicant: Jason Arnold, Rocky Hill, CT (US)

(72) Inventor: Jason Arnold, Rocky Hill, CT (US)

(73) Assignee: United Technologies Corporation, Hartford, CT (US)

( * ) Notice: Subject to any disclaimer, the term of this patent is extended or adjusted under 35 U.S.C. 154(b) by 816 days.

(21) Appl. No.: 13/629,082

(22) Filed: Sep. 27, 2012

(65) Prior Publication Data

US 2014/0086740 A1 Mar. 27, 2014

(51) Int. Cl.

| | |
|---|---|
| ***F01D 11/02*** | (2006.01) |
| ***F01D 11/00*** | (2006.01) |
| *F01D 5/06* | (2006.01) |

(52) U.S. Cl.

CPC ..... *F01D 11/001* (2013.01); *F01D 5/066* (2013.01)

(58) Field of Classification Search

CPC ..... F01D 11/001; F01D 5/066; F01D 11/12; F01D 11/122; F01D 11/125; F01D 11/127; F01D 11/006; F01D 5/3015; F01D 5/326

USPC ..... 415/173.7, 174.4, 174.5; 416/198 A, 416/200 A, 201 R, 220 R; 403/300, 306, 313, 403/341

See application file for complete search history.

(56) References Cited

U.S. PATENT DOCUMENTS

| | | | | |
|---|---|---|---|---|
| 2,741,454 | A * | 4/1956 | Eppley | 416/244 R |
| 4,558,988 | A | 12/1985 | Kisling et al. | |
| 4,582,467 | A | 4/1986 | Kisling | |
| 4,659,289 | A | 4/1987 | Kalogeros | |
| 4,803,893 | A | 2/1989 | Bachinski | |
| 5,288,210 | A * | 2/1994 | Albrecht et al. | 416/198 A |
| 5,310,319 | A | 5/1994 | Grant et al. | |
| 5,833,244 | A * | 11/1998 | Salt et al. | 277/421 |
| 6,315,298 | B1 | 11/2001 | Kildea et al. | |
| 2009/0148295 | A1 | 6/2009 | Caprario et al. | |
| 2010/0232938 | A1 | 9/2010 | Harris, Jr. et al. | |
| 2012/0177485 | A1 | 7/2012 | Virkler et al. | |
| 2012/0177495 | A1 | 7/2012 | Virkler et al. | |
| 2012/0244004 | A1 * | 9/2012 | Virkler | 416/220 R |

* cited by examiner

*Primary Examiner* — Christopher Verdier
(74) *Attorney, Agent, or Firm* — O'Shea Getz P.C.

(57) ABSTRACT

An interstage coverplate assembly is provided for a rotor assembly. The coverplate assembly includes an annular first coverplate, an annular second coverplate and an annular coverplate lock that extends axially between and rotatably connects the first and the second coverplates. The first coverplate includes a plurality of coverplate tabs arranged circumferentially around an axial centerline. The coverplate lock includes a plurality of lock tabs arranged circumferentially around the centerline. A first of the lock tabs circumferentially engages a first of the coverplate tabs.

20 Claims, 4 Drawing Sheets

INTERSTAGE COVERPLATE ASSEMBLY FOR ARRANGING BETWEEN ADJACENT ROTOR STAGES OF A ROTOR ASSEMBLY

BACKGROUND OF THE INVENTION

1. Technical Field

This disclosure relates generally to a rotor assembly and, more particularly, to an interstage coverplate assembly for arranging between adjacent rotor stages of, for example, a turbine engine rotor assembly.

2. Background Information

A typical turbine engine includes a stator assembly and a rotor assembly having a plurality of rotor stages. The stator assembly includes a plurality of stator vanes that are arranged axially between the rotor stages. Radial inner ends of the stator vanes may be connected to an annular seal land. Each of the rotor stages may include a plurality of rotor blades that are connected to a respective rotor disk. The rotor assembly may also include an interstage coverplate assembly having a plurality of coverplates. Each of the coverplates is independently connected to a side of a respective one of the rotor disks, and each of the coverplates may include one or more knife edge seals that engage the seal land.

There is a need in the art for an improved interstage coverplate assembly.

SUMMARY OF THE DISCLOSURE

According to an aspect of the invention, an interstage coverplate assembly is provided for a turbine engine rotor assembly. The coverplate assembly includes an annular first coverplate, an annular second coverplate and an annular coverplate lock, which extends axially between and rotatably connects the first and the second coverplates. The first coverplate includes a plurality of coverplate tabs arranged circumferentially around an axial centerline. The coverplate lock includes a plurality of lock tabs arranged circumferentially around the centerline. A first of the lock tabs circumferentially engages a first of the coverplate tabs.

According to another aspect of the invention, a rotor assembly with an axial centerline is provided that includes a plurality of rotor stages, a first coverplate, a second coverplate, and a coverplate lock, which extends axially between and rotatably connects the first and the second coverplates. Each of the rotor stages includes a plurality of rotor blades connected to a rotor disk. The first coverplate engages a first of the rotor stages, and includes a plurality of coverplate tabs arranged circumferentially around the centerline. The second coverplate engages a second of the rotor stages. The coverplate lock includes a plurality of lock tabs arranged circumferentially around the centerline. A first of the lock tabs circumferentially engages a first of the coverplate tabs.

The second coverplate and the coverplate lock may be configured as a unitary body.

The second coverplate may include a plurality of second coverplate tabs that are arranged circumferentially around the centerline. The coverplate lock may include a plurality of second lock tabs that are arranged circumferentially around the centerline. A first of the second lock tabs may circumferentially engage a first of the second coverplate tabs.

The first coverplate may extend radially inwards to a first inner coverplate end, and the coverplate tabs may be arranged at the first inner coverplate end. The second coverplate may extend radially inwards to a second inner coverplate end, and the second coverplate tabs may be arranged at the second inner coverplate end. The coverplate lock may extend axially between a first lock end and a second lock end. The lock tabs may be arranged at the first lock end, and/or the second lock tabs may be arranged at the second lock end.

The first coverplate may extend radially inwards to an inner coverplate end, and the coverplate tabs may be arranged at the inner coverplate end. The coverplate lock may extend axially to a lock end, and the lock tabs may be arranged at the lock end.

The coverplate tabs may extend radially to respective distal coverplate tab ends. The lock tabs may extend axially to respective distal lock tab ends. A side of the first lock tab may circumferentially engage a side of the first coverplate tab.

The first coverplate may include a first coverplate segment and a second coverplate segment. The first coverplate segment may extend radially from the second coverplate segment to an outer coverplate end. The second coverplate segment may extend axially from the first coverplate segment to a distal segment end. The coverplate tabs may extend radially inwards from the second coverplate segment, for example, at the segment end.

The first and/or the second coverplates may include a seal flange and a knife edge seal. The seal flange may extend axially from a coverplate body towards the coverplate lock. The knife edge seal may extend radially out from the seal flange.

The first and/or the second coverplates may include one or more concentric retainer flanges that extend axially from a coverplate body away from the coverplate lock.

The rotor disk of the first of the rotor stages may include a rail with a plurality of slots. The rail may be arranged axially between the first coverplate and a body of the coverplate lock. The first of the lock tabs may extend axially through a first of the slots to engage the first of the coverplate tabs.

The rotor disk of the second of the rotor stages may include a second rail with a plurality of second slots. The second rail may be arranged axially between the second coverplate and the body of the coverplate lock. The first of the second lock tabs may extend axially through a first of the second slots to engage the first of the second coverplate tabs.

The rotor disk of at least one of the rotor stages may include one or more axially extending retainer shelves. The first and/or the second coverplates may include one or more axially extending retainer flanges that radially engage the retainer shelves.

In some embodiments, the rotor stages may be configured as turbine rotor stages. In other embodiments, the rotor stages may be configured as compressor rotor stages. In still other embodiments, the rotor stages may be configured as fan rotor stages.

The foregoing features and the operation of the invention will become more apparent in light of the following description and the accompanying drawings.

DETAILED DESCRIPTION OF THE INVENTION

Figure 1:
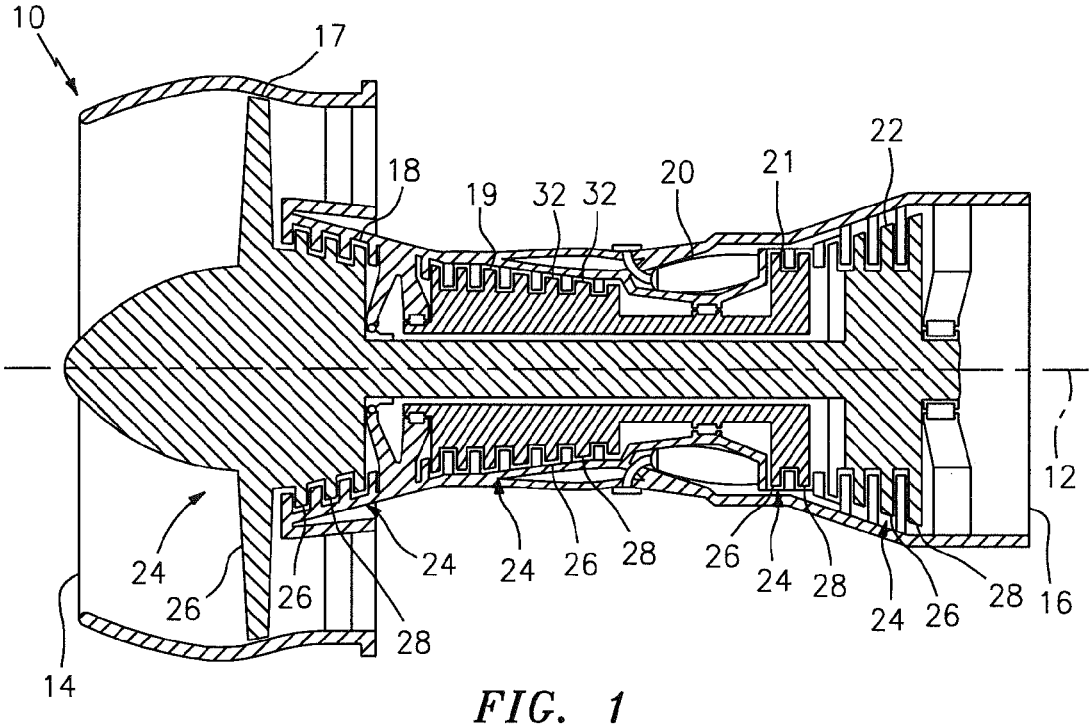
FIG. 1 is a sectional illustration of a turbine engine.
Figure 2:
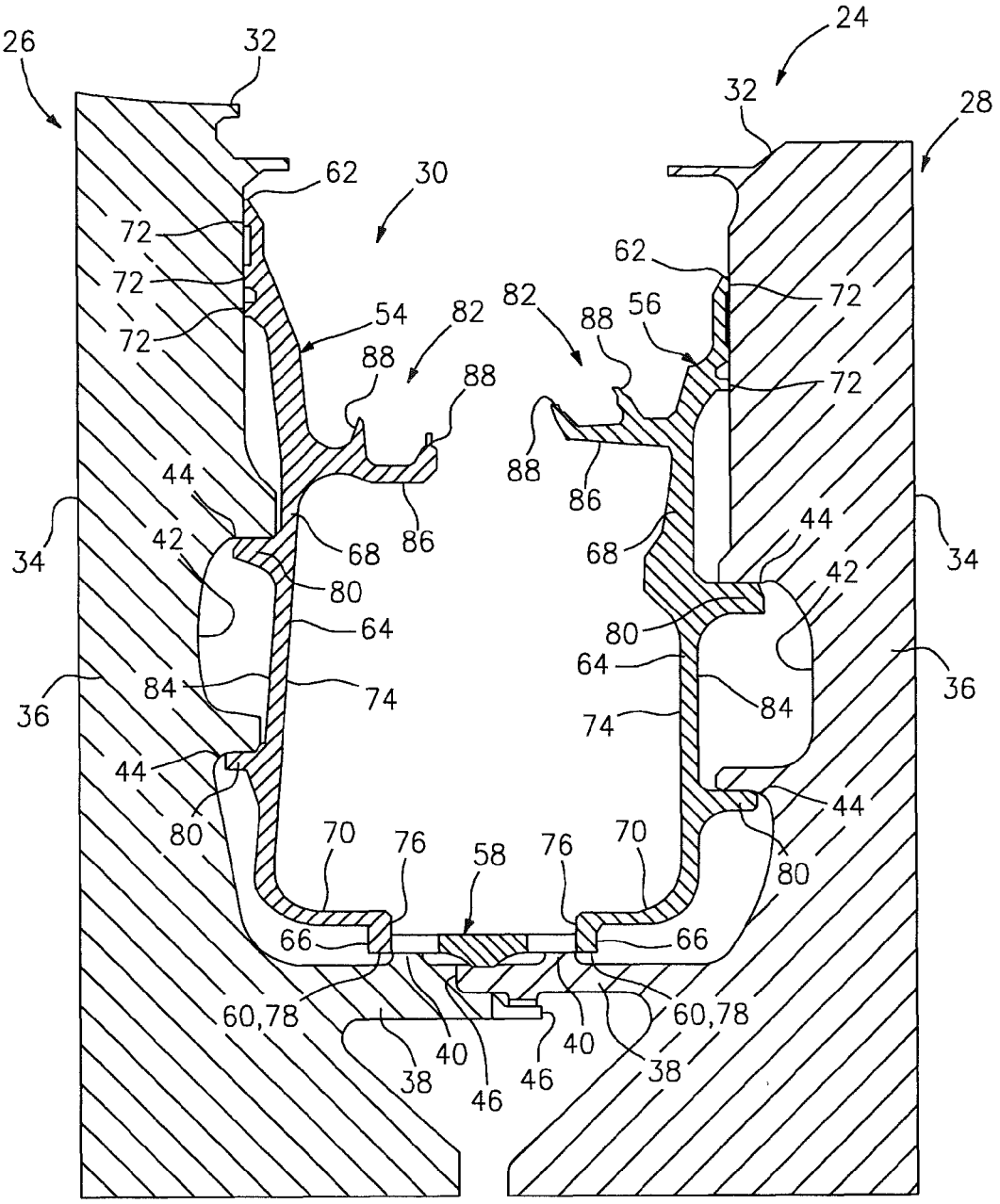
FIG. 2 is a partial sectional illustration of a rotor assembly for the engine of FIG. 1.

FIG. 1 illustrates a turbine engine 10 that extends along an axial centerline 12 between a forward airflow inlet 14 and an aft airflow exhaust 16. The engine 10 includes a plurality of engine sections such as, for example, a fan section 17, one or more (e.g., low and high pressure) compressor sections 18 and 19, a combustor section 20, and one or more (e.g., high and low pressure) turbine sections 21 and 22. Each of the engine sections 17-19, 21 and 22 includes a rotor assembly 24, which includes one or more (e.g., fan, compressor or turbine) rotor stages 26 and 28. Referring to FIG. 2, the rotor assembly 24 of one or more of the engine sections (e.g., the sections 18, 19, 21 and/or 22) also includes an interstage coverplate assembly 30.

Figure 5:
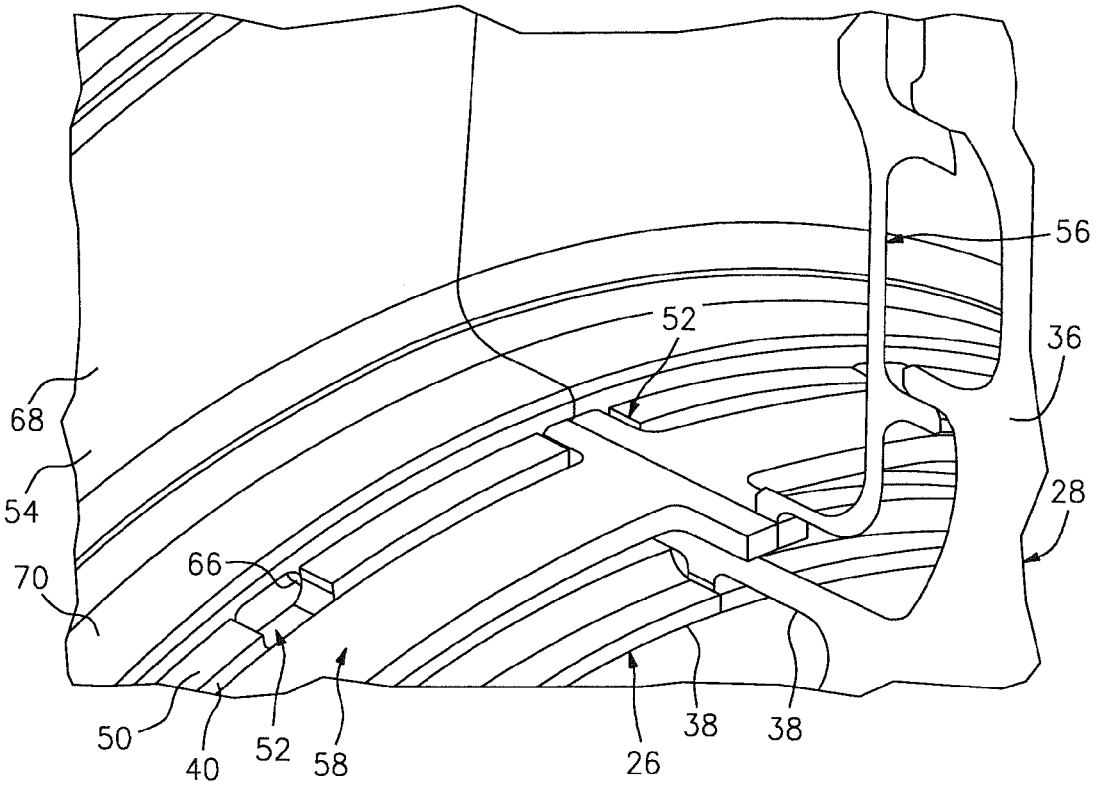
FIG. 5 is a cutaway perspective illustration of a portion of the rotor assembly of FIG. 2.
Figure 3:
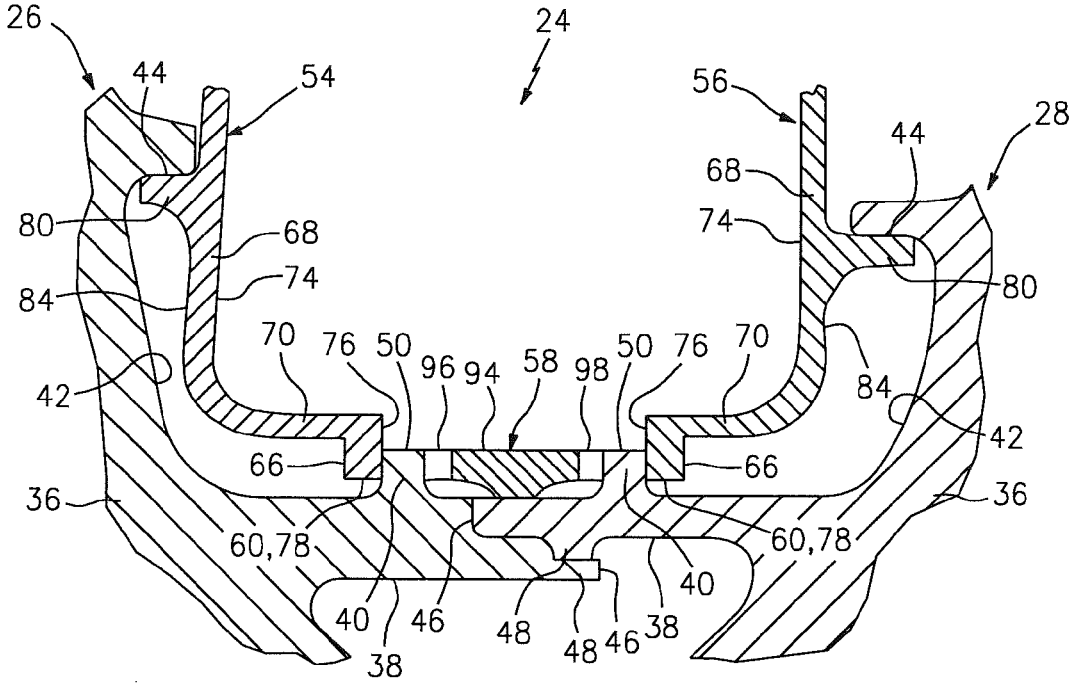
FIG. 3 is a sectional illustration of a portion of the rotor assembly of FIG. 2.
Figure 4:
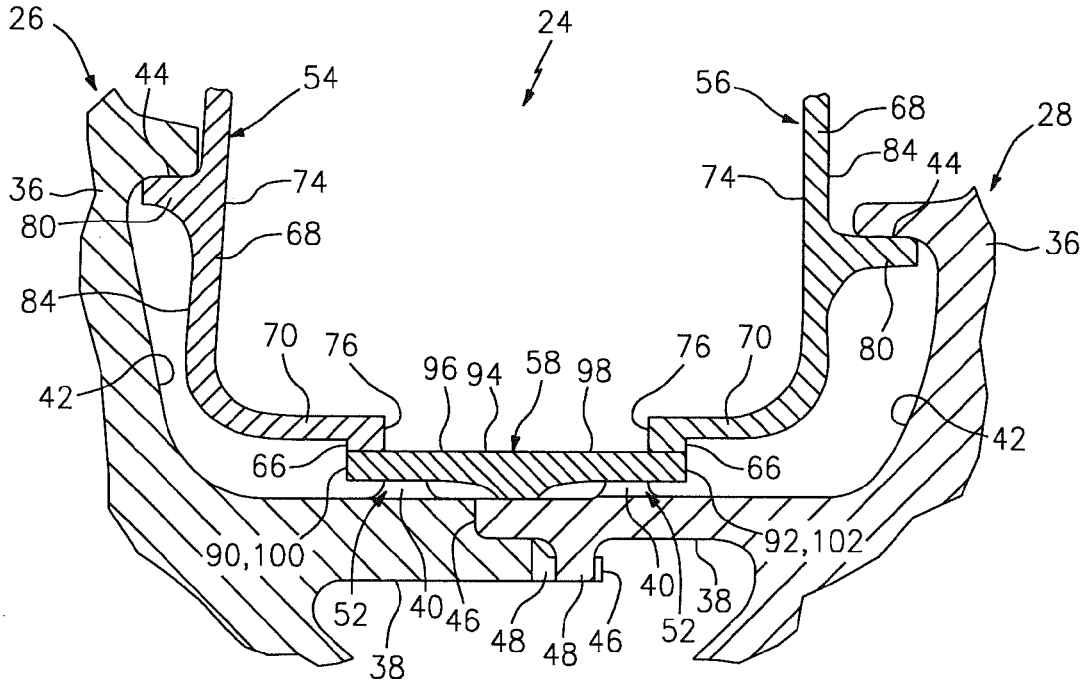
FIG. 4 is another sectional illustration of a portion of the rotor assembly of FIG. 2.

Each of the rotor stages 26 and 28 includes a plurality of rotor blades 32 arranged circumferentially around and connected to a rotor disk 34. The rotor disk 34 includes an annular disk body 36, an annular coupling flange 38 and an annular rail 40 (see also FIG. 1). The disk body 36 extends axially between opposing disk sides 42, one of which may include one or more (e.g., concentric) axially extending retaining shelves 44. Referring to FIGS. 3 and 4, the coupling flange 38 extends axially from a respective one of the disk sides 42 to a distal flange end 46. The coupling flange 38 may include a castellated segment 48 arranged at (e.g., proximate or adjacent to) the flange end 46. The rail 40 extends radially out from a radial outer side of the coupling flange 38 to a distal rail end 50. Referring to FIG. 5, the rail 40 includes a plurality of slots 52 arranged circumferentially around the centerline. The slots 52 extend axially through the rail 40, and radially into the rail 40 from the rail end 50.

Referring to FIG. 2, the coverplate assembly 30 includes a plurality of annular coverplates 54 and 56 and an annular coverplate lock 58. Each of the coverplates 54 and 56 extends radially between a radial inner coverplate end 60 and a radial outer coverplate end 62. One or more (e.g., each) of the coverplates 54 and 56 may include an annular coverplate body 64 and a plurality of coverplate tabs 66. The coverplate body 64 may include one or more coverplate segments 68 and 70. The first coverplate segment 68 extends radially from the second coverplate segment 70 to the outer coverplate end 62. The first coverplate segment 68 may include one or more seal surfaces 72 arranged at, for example, the outer coverplate end 62. The second coverplate segment 70 extends axially from a first side 74 of the first coverplate segment 68 to a distal segment end 76. The coverplate tabs 66 are arranged circumferentially around the centerline, for example, at the segment end 76. The coverplate tabs 66 extend radially inward from the second coverplate segment 70 to respective distal coverplate tab ends 78, for example, at the inner coverplate end 60.

One or more (e.g., each) of the coverplates 54 and 56 may also include one or more (e.g., concentric) annular retainer flanges 80 and an annular seal 82. The retainer flanges 80 extend axially from a second side 84 of the first coverplate segment 68. One or more of the retainer flanges 80 may be arranged radially between the second coverplate segment 70 and the seal 82. The seal 82 may be arranged axially between the retainer flanges 80 and the seal surfaces 72. The seal 82 embodiment of FIG. 2 includes a seal flange 86 and a plurality of knife edge seals 88. The seal flange 86 extends axially out from the first side 74 of the first coverplate segment 68. The knife edge seals 88 extend radially out from a radial outer side of the seal flange 86, and are adapted to engage an annular seal land (not shown).

Referring to FIGS. 3 and 4, the coverplate lock 58 extends axially between a first (e.g., forward) lock end 90 and a second (e.g., aft) lock end 92. The coverplate lock 58 includes a lock body 94, a plurality of first lock tabs 96, and a plurality of second lock tabs 98. The lock body 94 extends axially between the first and the second lock tabs 96 and 98, which are arranged circumferentially around the centerline. The first lock tabs 96 extend axially from the lock body 94 to respective distal lock tab ends 100 at the first lock end 90. The second lock tabs 98 extend axially from the lock body 94 to respective distal lock tab ends 102 at the second lock end 92.

Referring to FIGS. 2 and 5, each of the coverplates 54 and 56 is mounted to a respective one of the rotor stages 26 and 28. The second coverplate segment 70, for example, is slid axial onto the coupling flange 38 such that the coverplate tabs 66 pass respectively through the slots 52. The coverplate 54, 56 may subsequently be rotated such that the coverplate tabs 66 engage (e.g., contact, abut, are face-to-face, etc.) an axial side of the rail 40 (see FIG. 3). Referring to FIG. 2, radial outer sides of the retainer flanges 80 radially engage the retainer shelves 44. The seal surfaces 72 axially engage, for example, blade roots of the rotor blades 32. Each of the coverplates 54 and 56 therefore is arranged and secured axially between the disk body 36 and the rail 40.

Referring to FIGS. 3 and 4, the castellated segments 48 are mated to rotatably connect the first and the second rotor stages 26 and 28 together. The lock body 94 is arranged axially between the rails 40. Each of the first lock tabs 96 extends axially through a respective one of the slots 52 of the first rotor stage 26. A circumferential side of one or more (e.g., each) of the first lock tabs 96 circumferentially engages a circumferential side of a respective one of the coverplate tabs 66 of the first coverplate 54. Each of the second lock tabs 98 extends axially through a respective one of the slots 52 of the second rotor stage 28. A circumferential side of one or more (e.g., each) of the second lock tabs 98 circumferentially engages a circumferential side of a respective one of the coverplate tabs 66 of the second coverplate 56. The coverplate lock 58 therefore rotatably connects the first and the second coverplates 54 and 56 together as well as to the first and the second rotor stages 26 and 28.

Figure 6:
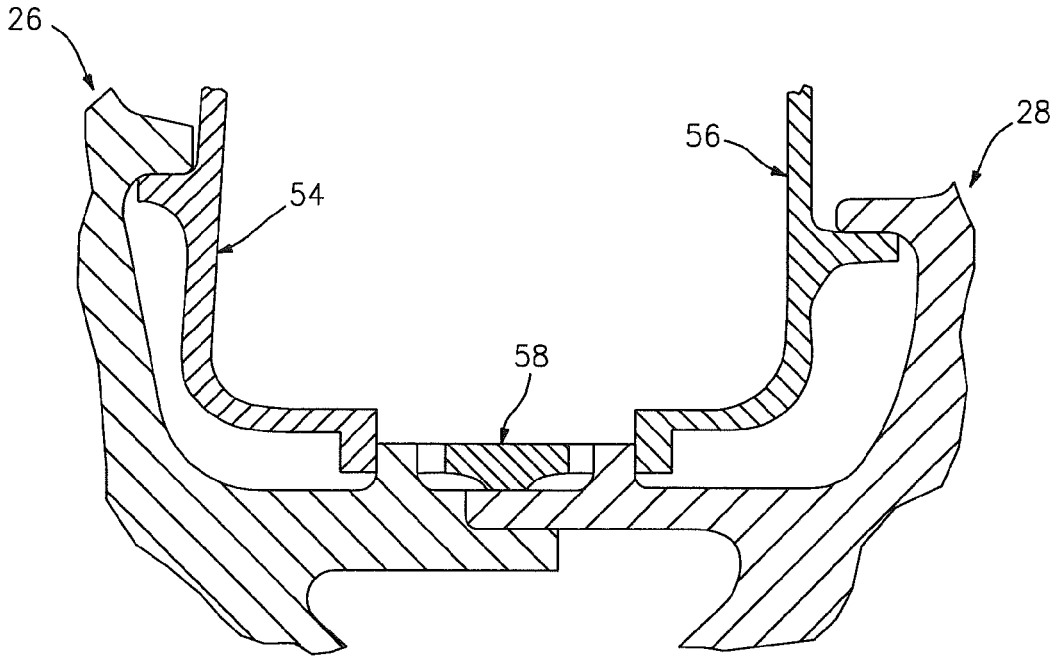
FIG. 6 is a partial sectional illustration of an alternative embodiment rotor assembly.

In some embodiments, for example as illustrated in FIG. 6, the castellated segments 48 (see FIGS. 3 and 4) of the first and the second rotor stages 26 and 28 may be omitted. In such embodiments, the coverplate lock 58 may be sized to rotatably connect and transfer torque between the first and the second rotor stages 26 and 28.

Figure 7:
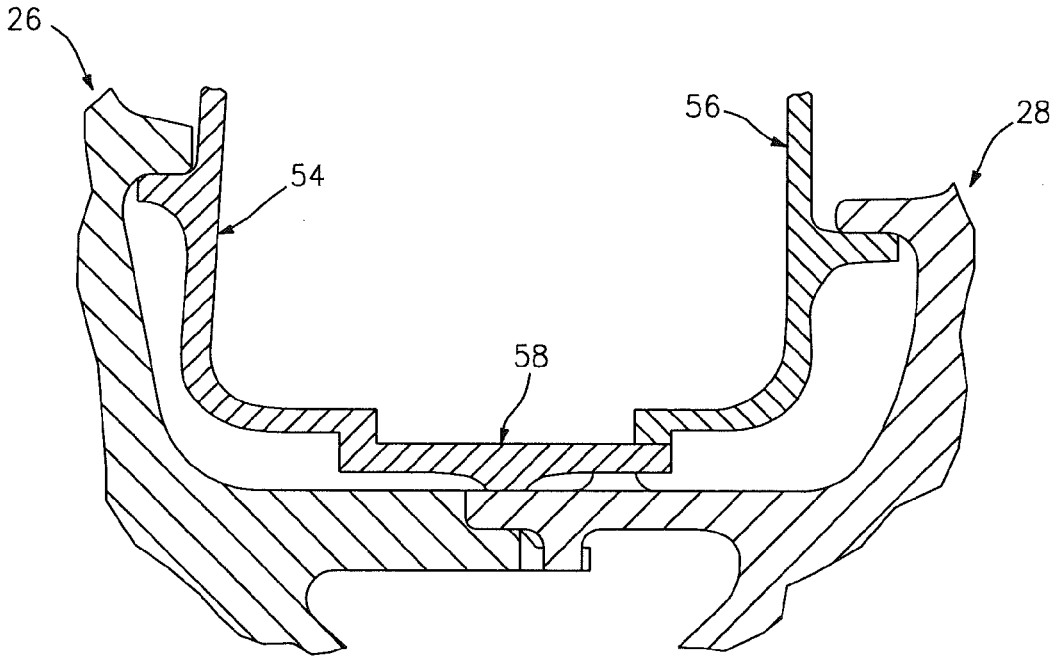
FIG. 7 is a partial sectional illustration of another alternative embodiment rotor assembly.

In some embodiments, the coverplate lock 58 and the first or the second coverplates 54 and 56 may be configured as a unitary body. In the embodiment of FIG. 7, for example, the coverplate lock 58 is formed (e.g., cast and/or machined) as part of the first coverplate 54.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. An interstage coverplate assembly for a turbine engine rotor assembly including a plurality of bladed rotor stages, each of the bladed rotor stages including a plurality of rotor blades connected to a rotor disk, the assembly comprising:

an annular first coverplate including a plurality of coverplate tabs arranged circumferentially around an axial centerline, wherein the first coverplate is configured to engage a first of the bladed rotor stages;

an annular second coverplate configured to engage a second of the bladed rotor stages; and an annular coverplate lock extending axially between and rotatably connecting the first and the second coverplates, the coverplate lock including a plurality of lock tabs arranged circumferentially around the centerline, wherein a first of the lock tabs circumferentially engages a first of the coverplate tabs.

2. The coverplate assembly of claim 1, wherein the second coverplate and the coverplate lock are configured as a unitary body.

3. The coverplate assembly of claim 1, wherein the second coverplate includes a plurality of second coverplate tabs that are arranged circumferentially around the centerline; and the coverplate lock further includes a plurality of second lock tabs that are arranged circumferentially around the centerline, and a first of the second lock tabs circumferentially engages a first of the second coverplate tabs.

4. The coverplate assembly of claim 3, wherein the first coverplate extends radially inwards to a first inner coverplate end, and the coverplate tabs are arranged at the first inner coverplate end; and the second coverplate extends radially inwards to a second inner coverplate end, and the second coverplate tabs are arranged at the second inner coverplate end.

5. The coverplate assembly of claim 3, wherein the coverplate lock extends axially between a first lock end and a second lock end, the lock tabs are arranged at the first lock end, and the second lock tabs are arranged at the second lock end.

6. The coverplate assembly of claim 1, wherein the first coverplate extends radially inwards to an inner coverplate end, and the coverplate tabs are arranged at the inner coverplate end; and the coverplate lock extends axially to a lock end, and the lock tabs are arranged at the lock end.

7. The coverplate assembly of claim 1, wherein the coverplate tabs extend radially to respective distal coverplate tab ends, the lock tabs extend axially to respective distal lock tab ends, and a side of the first lock tab circumferentially engages a side of the first coverplate tab.

8. The coverplate assembly of claim 7, wherein the first coverplate further includes a first coverplate segment and a second coverplate segment;

the first coverplate segment extends radially from the second coverplate segment to an outer coverplate end, and the second coverplate segment extends axially from the first coverplate segment to a distal segment end; and the coverplate tabs extend radially inwards from the second coverplate segment at the segment end.

9. The coverplate assembly of claim 1, wherein at least one of the first and the second coverplates includes a seal flange that extends axially from a coverplate body towards the coverplate lock, and a knife edge seal that extends radially out from the seal flange.

10. The coverplate assembly of claim 1, wherein at least one of the first and the second coverplates includes one or more concentric retainer flanges that extend axially from a coverplate body away from the coverplate lock.

11. A rotor assembly with an axial centerline, comprising:

a plurality of rotor stages, each of the rotor stages including a plurality of rotor blades connected to a rotor disk;

a first coverplate engaging a first of the rotor stages, and including a plurality of coverplate tabs arranged circumferentially around the centerline;

a second coverplate engaging a second of the rotor stages; and a coverplate lock extending axially between and rotatably connecting the first and the second coverplates, the coverplate lock including a plurality of lock tabs arranged circumferentially around the centerline, wherein a first of the lock tabs circumferentially engages a first of the coverplate tabs.

12. The assembly of claim 11, wherein the rotor disk of the first of the rotor stages includes a rail with a plurality of slots;

the rail is arranged axially between the first coverplate and a body of the coverplate lock; and the first of the lock tabs extends axially through a first of the slots to engage the first of the coverplate tabs.

13. The assembly of claim 12, wherein the second coverplate includes a plurality of second coverplate tabs that are arranged circumferentially around the centerline; and the coverplate lock further includes a plurality of second lock tabs that are arranged circumferentially around the centerline, and a first of the second lock tabs circumferentially engages a first of the second coverplate tabs.

14. The assembly of claim 13, wherein the first coverplate extends radially inwards to a first inner coverplate end, and the coverplate tabs are arranged at the first inner coverplate end; and the second coverplate extends radially inwards to a second inner coverplate end, and the second coverplate tabs are arranged at the second inner coverplate end.

15. The assembly of claim 13, wherein the coverplate lock extends axially between a first lock end and a second lock end, the lock tabs are arranged at the first lock end, and the second lock tabs are arranged at the second lock end.

16. The assembly of claim 13, wherein the rotor disk of the second of the rotor stages includes a second rail with a plurality of second slots;

the second rail is arranged axially between the second coverplate and the body of the coverplate lock; and the first of the second lock tabs extends axially through a first of the second slots to engage the first of the second coverplate tabs.

17. The assembly of claim 11, wherein the coverplate tabs extend radially to respective distal coverplate tab ends, the lock tabs extend axially to respective distal lock tab ends, and a side of the first lock tab circumferentially engages a side of the first coverplate tab.

18. The assembly of claim 11, wherein at least one of the first and the second coverplates includes a seal flange that extends axially from a coverplate body towards the coverplate lock, and a knife edge seal that extends radially out from the seal flange.

19. The assembly of claim 11, wherein the rotor disk of at least one of the rotor stages includes one or more axially extending retainer shelves; and at least one of the first and the second coverplates includes one or more axially extending retainer flanges that radially engage the retainer shelves.

20. The assembly of claim 11, wherein the rotor stages comprise turbine rotor stages.

* * * * *